US005412822A

United States Patent [19]

Kelly

[11] Patent Number: 5,412,822

[45] Date of Patent: May 9, 1995

[54] ADJUSTABLE MULTI-COMPARTMENT PNEUMATIC SUPPORT APPARATUS

[76] Inventor: Bryan J. Kelly, 5566 - 6th Avenue, Delta, British Columbia, Canada, V4M 1M1

[21] Appl. No.: 136,137

[22] Filed: Oct. 15, 1993

[51] Int. Cl.[6] ..... A47C 27/08

[52] U.S. Cl. ..... 5/455; 5/449; 5/457; 5/464; 5/654

[58] Field of Search ..... 5/644, 449, 455, 457, 5/464, 654, 655

[56] References Cited

U.S. PATENT DOCUMENTS

| | | | |
|---|---|---|---|
| 3,503,084 | 3/1970 | Meinweiser | 5/457 |
| 3,600,727 | 8/1971 | All | 5/455 X |
| 3,705,429 | 12/1972 | Nail | 5/455 |
| 4,136,412 | 1/1979 | Wilhelm | 5/455 X |
| 4,685,163 | 8/1987 | Quillen et al. | 5/615 X |
| 4,829,614 | 5/1989 | Harper | 5/644 |
| 4,965,899 | 10/1990 | Sekido et al. | 5/457 X |
| 5,070,559 | 12/1991 | Peffifer | 5/455 |
| 5,092,007 | 3/1992 | Hasty | 5/455 X |

FOREIGN PATENT DOCUMENTS

| | | | |
|---|---|---|---|
| 1019362 | 1/1953 | France | 5/455 |
| 1202100 | 1/1960 | France | 5/455 |
| 2648999 | 1/1991 | France | 5/644 |

OTHER PUBLICATIONS

ROHO Custom Cushions Catalogue.

"AirPedic Beds", Canada's Furniture Magazine, Jul.-/Aug., 1985.

"Select Comfort Sleep Systems" Product Information Sheet.

"OBUS Forme" Product Information Sheets.

"Normalizer", Omega Posture Systems Inc., Product Information Sheet.

"Better Back–The Orthopedic Multi–Purpose Seat", Orthopedic Products Corp., Product Information Sheet.

Pass*Form Product Information Sheet.

Product Information Sheet, Spears & Schuster Inc., pp. 4–12.

Product Information Sheet, p. 566 A.

Mail Order Marketplace–Product Information Sheet.

*Primary Examiner*—Michael F. Trettel

*Attorney, Agent, or Firm*—Oyen Wiggs Green & Mutala

[57] ABSTRACT

This invention is directed to a novel adjustable multi-compartment inflatable form support. More particularly, this invention pertains to a novel multi-compartment pneumatic or hydraulic support form which has multiple chambers, each of which can be inflated or hydraulically filled to different pressures to provide different shapes and degrees of support. An adjustable multi-compartment inflatable or hydraulically filled support form comprising: (a) at least one first hollow chamber which can be individually inflated or hydraulically filled through a specific resealable valve; (b) at least one second hollow chamber which can be individually inflated or filled through a specific resealable valve; and (c) at least one third hollow chamber which can be individually inflated or filled through a specific resealable valve.

17 Claims, 6 Drawing Sheets

ADJUSTABLE MULTI-COMPARTMENT PNEUMATIC SUPPORT APPARATUS

FIELD OF THE INVENTION

This invention is directed to a novel adjustable multi-compartment inflatable form support. More particularly, this invention pertains to a novel multi-compartment pneumatic or hydraulic support form which has multiple chambers, each of which can be inflated or hydraulically filled to different pressures to provide different shapes and degrees of support.

BACKGROUND OF THE INVENTION

For centuries, human beings have required various soft resilient supports for daily activities. For instance, pillows are widely used for supporting a person's head while asleep. Cushions are widely used to support a person's back or lumbar region while sitting. Mattresses are widely used for supporting the body of a person while asleep. Such support forms can be formed of many materials, including inner spring mattresses, stuffed resilient fabrics, resilient pliable foams such as polyurethane foam and latex foam, or inflatable articles.

In hospital environments, and in physical fitness environments, a number of devices have been developed over the years for supporting patients and exercisers in various situations. Roho Incorporated has developed and sells a number of articles which are used to support a patient in a hospital environment. The Roho air flotation system is an air-inflatable device consisting of many flexible air cells attached to a common manifold system. It provides optimum pressure distribution to facilitate healing of ulcers as well as the prevention of tissue breakdown in a convalescing patient. The device is light in weight. A specific Roho innovation is a heel pad which is specifically designed to support the heel of a patient suffering from ischemic heel ulcer. A number of variations are available, for instance a deep cushion having multiple chambers, a V-shaped cushion with multiple air cells, a back support cushion with multiple air cells, a partial ring having multiple air cells, a hollow square cushion. A problem with the simple Roho air flotation system is that the pressures in each of the flexible air cells cannot be individually adjusted. A manifold or multiple manifold option is required for multiple adjustment.

Halcyon markets a multitube air bladder system under the trade-mark AIRPEDIC TM beds. The multiple bladders are connected together to provide an angle support for convex areas, a flat support for horizontal use, and multiple bladders for use in a mattress configuration. The chambers are inflated to a constant pressure and the pressure in the chambers cannot be varied to any significant degree. There is no capability to inflate the individual chamber to separate pressures.

U.S. Pat. No. 5,113,875, Bennett, discloses an inflatable bolster with internal horizontal and vertical baffles in the interior. The baffles are not full and do not seal the bolster into separate compartments or chambers.

There is a strong need in various environments for various forms of an adjustable multi-compartment pneumatic support form, in which the various compartments can be inflated to desired pre-determined pressures to accommodate specific situations.

SUMMARY OF THE INVENTION

I have invented an adjustable multi-compartment support form, which can be constructed according to various design configurations, with each compartment custom inflatable to a specific required pressure.

This invention is directed to an adjustable multi-compartment inflatable or hydraulically fillable support form comprising: (a) at least one first hollow chamber which can be individually inflated or fluid filled through a specific resealable valve; (b) at least one second hollow chamber which can be individually inflated or fluid filled through a specific resealable valve; and (c) at least one third hollow chamber which can be individually inflated or fluid filled through a specific resealable valve.

The first chamber and the second chamber can be spaced from one another in parallel configuration, and a plurality of parallel third chambers can be positioned between the first chamber and the second chamber, and a pair of fourth chambers can be positioned on either end of the parallel third chambers, extending laterally between the first chamber and the second chamber.

The first chamber, the second chamber and the third chamber can be joined together in parallel configuration, and each chamber can be of the same overall length.

A pair of first chambers, each arranged parallel to and spaced from one another, with a plurality of second chambers arranged in parallel between a pair of first chambers, and a plurality of fourth chambers can be arranged on either side of the parallel series of first and second chambers.

The first, second and third chambers can be of the same size, and arranged parallel to one another, the chambers being connected to a flat pad.

Two first chambers can be curved to define an enclosed area, a second chamber can be positioned between meeting ends of the two curved first chambers, a plurality of parallel third chambers can be positioned betwen the facing ends of the two curved first chambers, and a second plurality of fourth chambers can be arranged in parallel, extending laterally between the interior portions of the two curved first inflatable chambers.

A pair of second head supporting chambers, a plurality of third shoulder supporting chambers, a plurality of first torso supporting chambers, an interconnecting series of fourth buttocks supporting chambers, a plurality of fifth thigh supporting chambers, a pair of sixth knee supporting chambers, a plurality of parallel seventh leg supporting chambers, and a plurality of eighth feet supporting chambers can be included.

The form may have a base and the chambers can be secured to the base. At least one of the chambers can be secured to another chamber instead of the base. At least one of the chambers can have a smaller chamber within the chamber. At least one of the chambers can be at least partially filled with foam.

The chambers can be inflated or filled to at least two pressures and the chambers can be arranged so that chambers with lower pressure adjoin chambers of higher pressure, and the configuration of individual chambers and lines of intersection between the chambers are staggered.

At least one of the chambers can have therein a partial baffle which is secured to an exterior wall of the chamber. The baffle can be configured to provide a desired contour to the exterior wall of the chamber.

The form can be enclosed in polymer foam or can be wrapped in an exterior fabric.

An external bridge can extend between at least two adjoining chambers of the form.

The invention is directed to an adjustable multicompartment inflatable or hydraulically fillable support form comprising: (a) at least one first hollow chamber which can be individually inflated or fluid filled through a specific resealable valve; (b) at least one second hollow chamber which can be individually inflated or fluid filled through a specific resealable valve; and (c) at least one third hollow chamber which can be individually inflated or fluid filled through a specific resealable valve; wherein the form has a base and the chambers are secured to the base, at least one of the chambers is secured to another chamber instead of the base, and the chambers are inflated or filled to at least two pressures and the chambers are arranged so that chambers with lower pressure adjoin chambers of higher pressure, and the configuration of individual chambers and lines of intersection between the chambers are staggered.

DRAWINGS

In drawings which illustrate specific embodiments of the invention but which should not be construed as limiting or restricting the spirit or scope of the invention in any way:

Figure 16A:
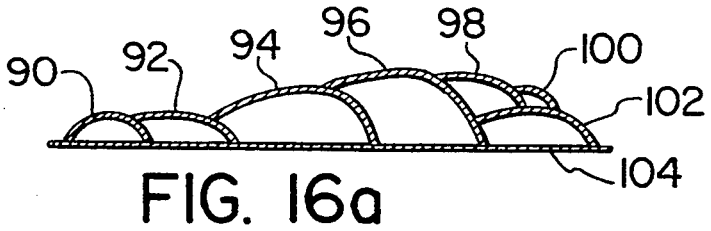
Figure 16B:
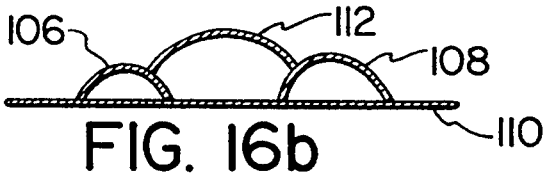
Figure 16C:
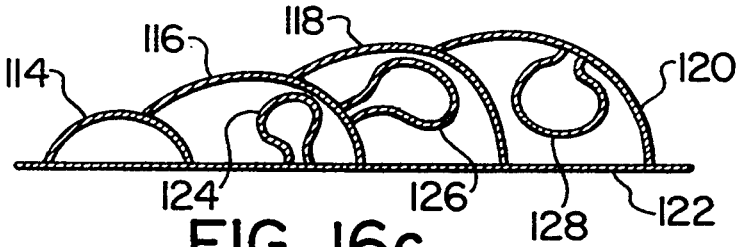
Figure 17:
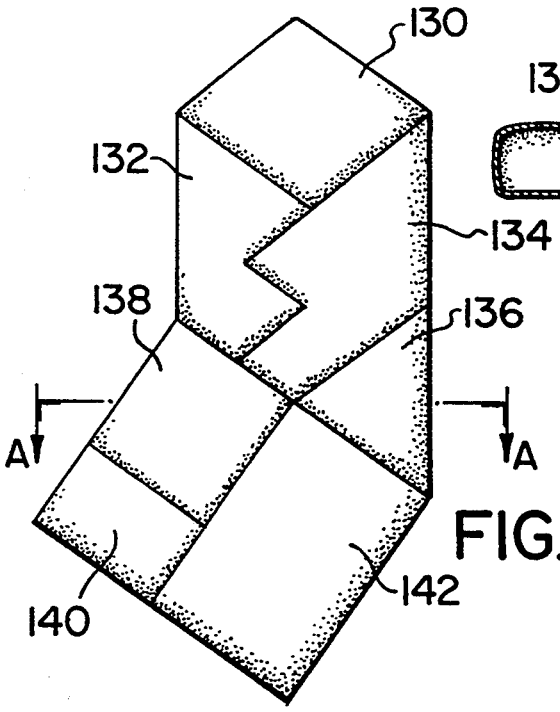
Figure 18:
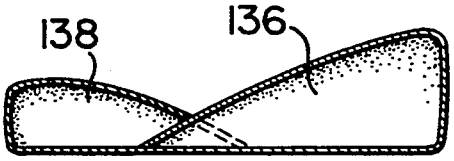
Figure 19:
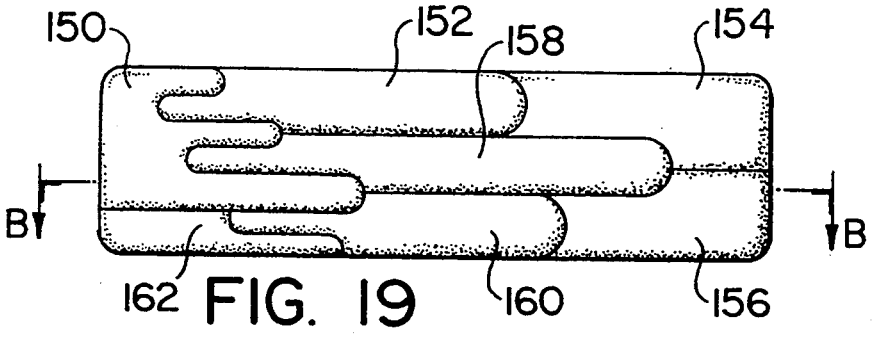
Figure 20:
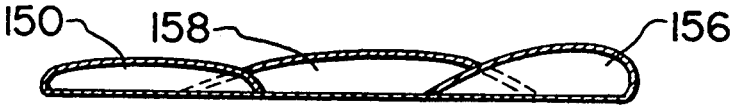
Figure 21:
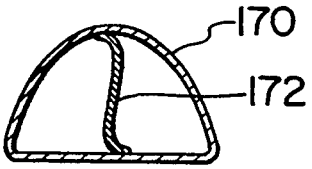
Figure 23:
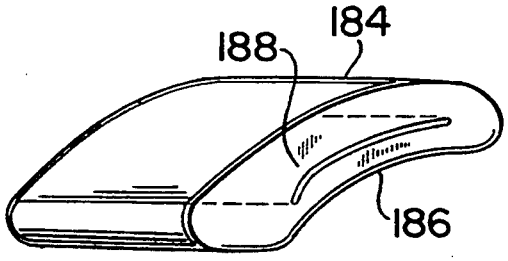
Figure 22:
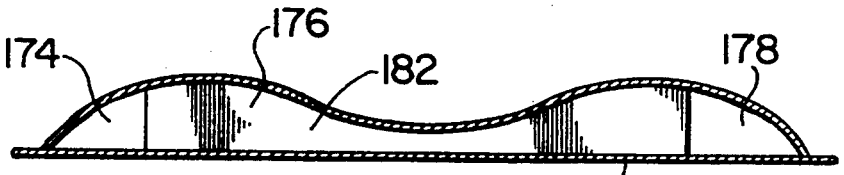
Figure 24:
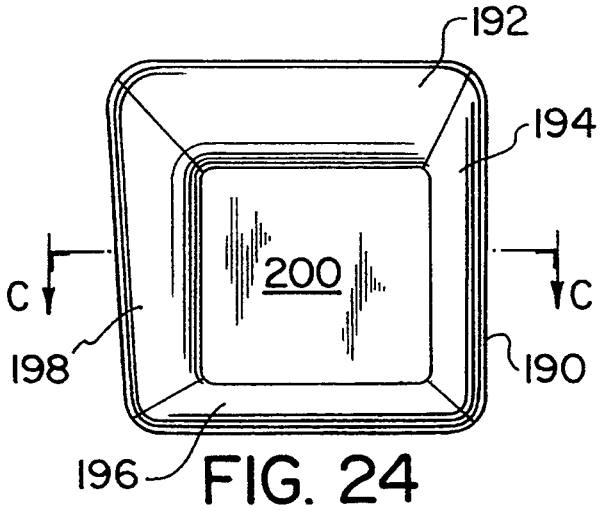
Figure 25:
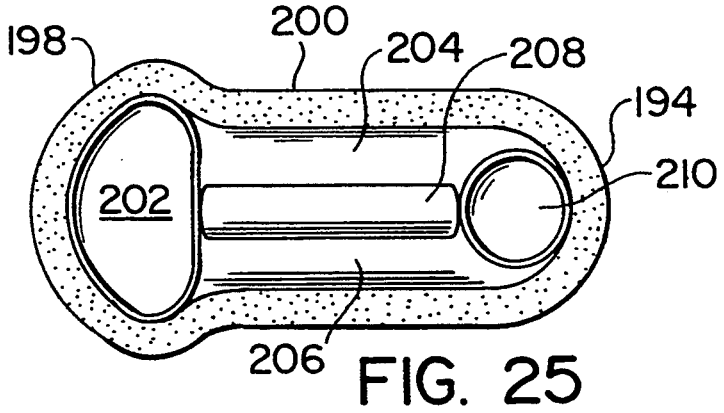
Figure 26:
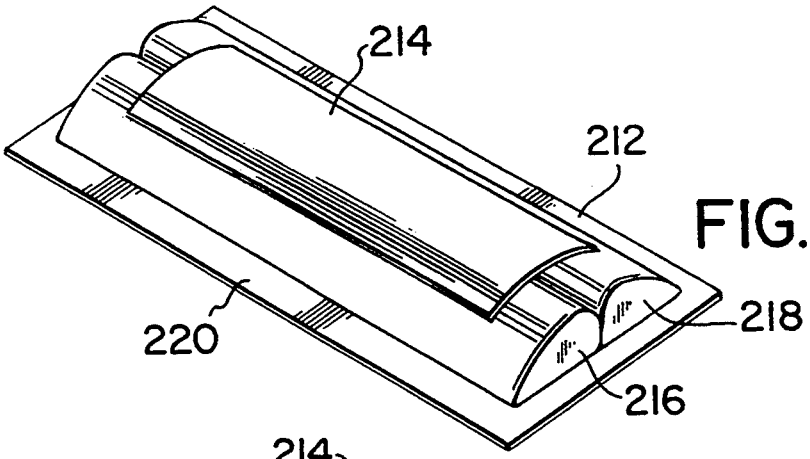
Figure 27:
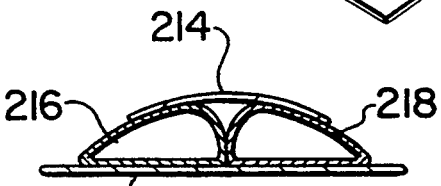

FIGS. 16*a*, 16*b* and 16*c* illustrates in cross-section three alternative embodiments of inflated or hydraulically filled multi-compartment supports;

FIG. 17 illustrates a top view of a support which has chambers inflated or filled to different pressures;

FIG. 18 illustrates a section view along section line A—A of the support of FIG. 17 with progressive intersecting chambers;

FIG. 19 illustrates a top view of an alternative embodiment of progressive intersecting chambers support;

FIG. 20 illustrates a side section view along section line B—B of the support of FIG. 19;

FIG. 21 illustrates a side section view of a chamber with internal baffle;

FIG. 22 illustrates a side section view of three chambers of a support with a vertical internal central baffle which shapes the top of the support;

FIG. 23 illustrates an isometric view of a support whose edge shape is governed by an internal baffle;

FIG. 24 illustrates a plan view of a multiple compartment loop cushion;

FIG. 25 illustrates a cross-section view along section line C—C of the cushion of FIG. 24;

FIG. 26 illustrates an isometric view of an inflated or hydraulically filled multi-compartment support with external bridge over adjourning chambers;

FIG. 27 illustrates a section view of the support and bridge of FIG. 26.

DETAILED DESCRIPTION OF SPECIFIC EMBODIMENTS OF THE INVENTION

Figure 1:
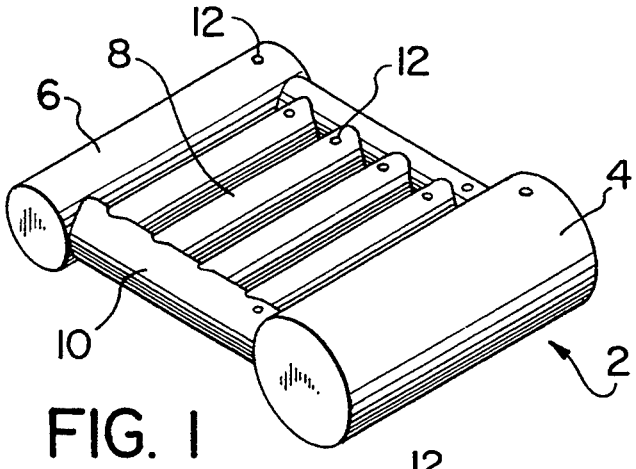
FIG. 1 illustrates an isometric view of an adjustable multi-compartment form.

Referring to the drawings, FIG. 1 illustrates an isometric view of the adjustable multi-compartment support form. The form 2 is constructed of an inflatable or hydraulically filled large chamber 4 and an inflatable or hydraulically filled medium chamber 6 at the opposite end. The two chambers 4 and 6 are connected by a series of parallel small interior, inflatable or fillable chambers 8, which are enclosed by an outside pair of inflatable small chambers 10 extending laterally between the medium chamber 6 and the large chamber 4. Each chamber is equipped with an individual air inflation or fluid fillable closure valve 12 (see FIG. 15 below). Having each chamber individually equipped with a closure valve enables each chamber to be custom inflated or filled to any desired pressure within reasonable limits required by the operator. This adjustable multi-compartment form 2 can itself be used as a pillow, or can be used under a conventional feather, polyester or down pillow. The form 2 can be rotated to fit the needs of any specific person. The form 2 can be inflated with air or filled with a suitable fluid such as water. The form, as with the other forms disclosed herein, is typically constructed of rubber-fabric or polymer-plastic components which can be glued or heat welded together. An adjustable multi-compartment individual inflatable chamber pillow is not currently available on the market.

Figure 2:
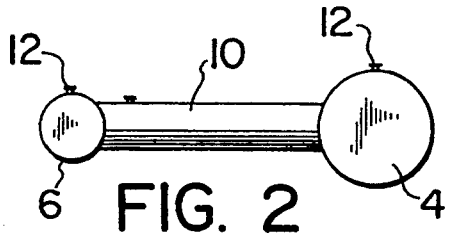
FIG. 2 illustrates a side view of an adjustable multi-compartment form.

FIG. 2 illustrates a side view of the adjustable multi-compartment form 2. The large inflatable or fluid fillable chamber 4 can be adjacent to the person sleeping in a bed if the person wants a high support created by the large chamber 4. Alternatively, if the person does not wish to have such a high support, the support 2 can be positioned so that the medium chamber 6 faces the head of the person. Further adjustment is possible by custom inflating or filling each chamber to the required degree of pressure.

Figure 3:
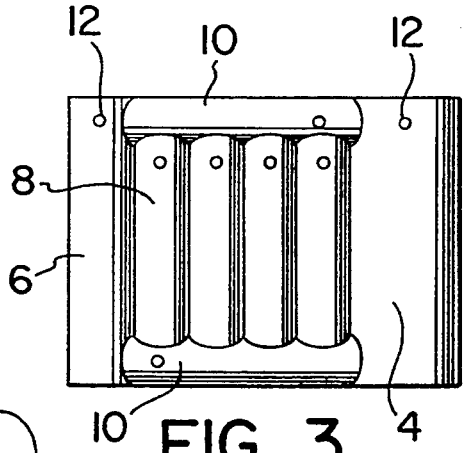
FIG. 3 illustrates a plan view of an adjustable multi-compartment form.

FIG. 3 illustrates a plan view of the adjustable multi-compartment form, and in particular shows the manner in which the large chamber 4, the medium chamber 6 and the small interior and exterior chambers 8 and 10 are connected together, with individual valves 12 for each individual chamber.

Figure 4:
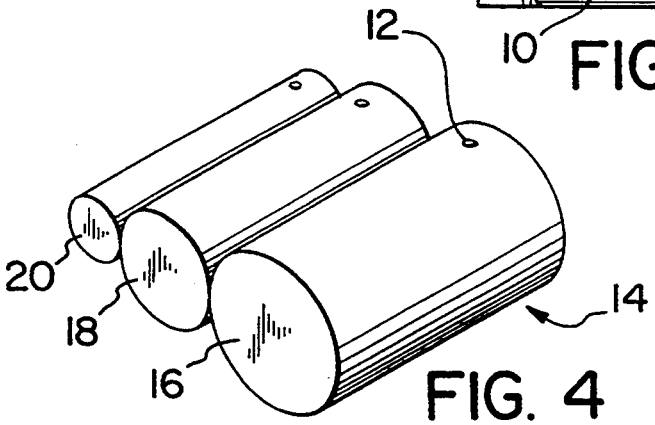
FIG. 4 illustrates an isometric view of an adjustable bed ramp.

FIG. 4 illustrates an isometric view of an adjustable bed ramp 14. The ramp 14 is constructed of a large inflatable or fluid fillable chamber 16, a medium size inflatable or fillable chamber 18, and a small inflatable or fillable chamber 20, each of which is equipped with an individual valve 12. The three chambers 16, 18 and 20 are connected together to provide a wedge-type configuration, when viewed from the side. There is currently available on the marketplace, foam wedges which are used to prop up the leg or back areas of a mattress. These foam wedges are not adjustable in size. There is nothing on the market which has multiple chambers which can be individually inflated or fluid filled to provide an adjustable bed ramp.

Figure 5:
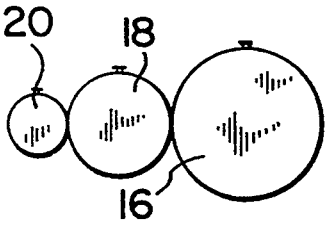
FIG. 5 illustrates a side view of an adjustable bed ramp.
Figure 6:
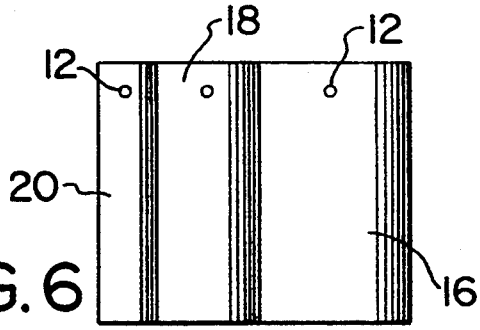
FIG. 6 illustrates a plan view of an adjustable bed ramp.

FIG. 5 illustrates a side view of the adjustable bed ramp, while FIG. 6 illustrates a plan view of the adjustable bed ramp. The three valves 12 are connected to the three individual chambers 16, 18 and 20.

Figure 7:
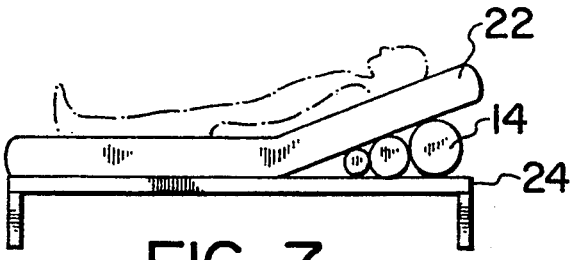
FIG. 7 illustrates a side view of an adjustable bed ramp used to support the head and shoulders area of a mattress.

FIG. 7 illustrates a side view of a person reclining on a mattress 22, positioned on a bed 24, with the adjustable bed ramp 14 propping up the torso and head portion of the mattress 22. Since each chamber of the bed ramp 14 is individually inflatable or fluid fillable, the desired angle of support for the mattress 22 can easily be obtained.

Figure 8:
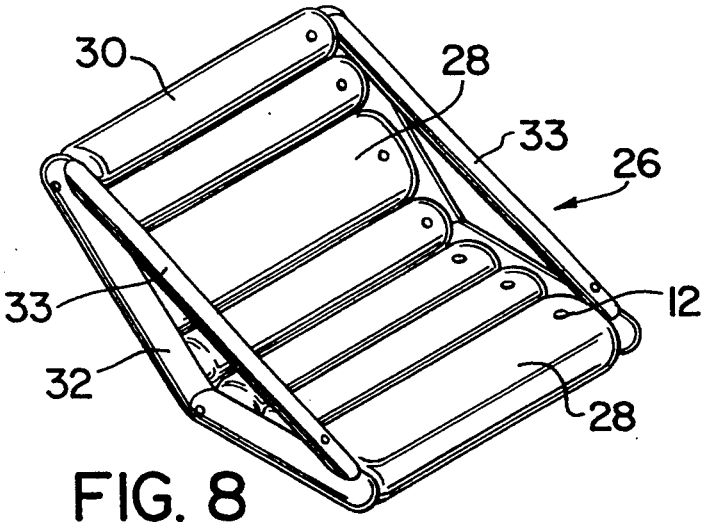
FIG. 8 illustrates an isometric view of a collapsible adjustable exercise chair form.

FIG. 8 illustrates an isometric view of an adjustable exercise chair form 26 which can be inflated or fluid filled to provide a support, and deflated to a collapsed position ready for easy packing and portability. The adjustable chair form 26, is designed to replace the ABDOMINIZER TM, which is a molded plastic exercise device widely sold in the marketplace. Disadvantages of the ABDOMINIZER TM are its high cost, and the fact that it is not collapsible and readily portable. The adjustable chair form 26 is constructed so that it has a pair of large inflatable or fluid filled chambers 28, one supporting the lumbar region, and the other supporting the hamstring area of an exerciser sitting on the form 26. A number of medium size parallel chambers 30, each individually inflatable to provide specific support to the exerciser, and supporting small chambers 32, on each side of the chair form 26. Each chamber has its own specific valve 12, which permits each chamber to be individually inflated or fluid filled to a specific required pressure. A pair of inflatable or fillable lateral supports 33, hold the "back" portion and the "seat" portion of the chair form 26 in position, while the exerciser rocks the form 26 back and forth while exercising.

Figure 9:
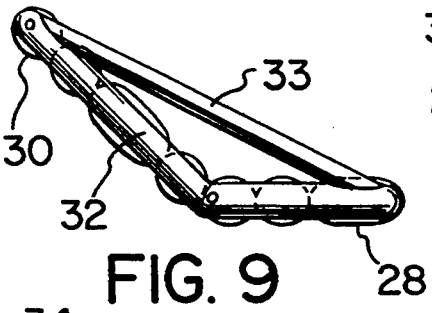
FIG. 9 illustrates a side view of an adjustable exercise chair form.
Figure 10:
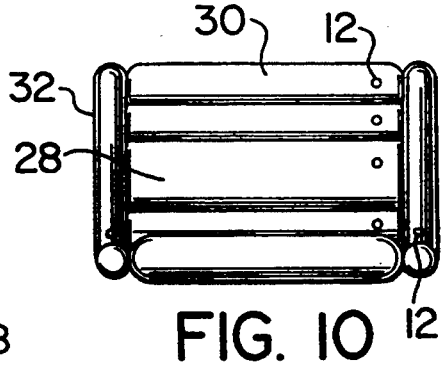
FIG. 10 illustrates a plan view of an adjustable exercise chair form.

FIG. 9 illustrates a side view of the exercise chair form 26, while FIG. 10 illustrates a front view of the exercise chair form 26. FIG. 9 illustrates how the small side chambers 32 hold the series of lateral chambers 28 and 30 in fixed position. FIG. 10 specifically illustrates a number of the individual valves 12 by which each chamber can be individually inflated or fluid filled.

Figure 11:
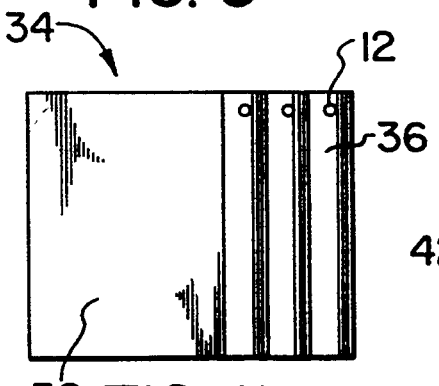
FIG. 11 illustrates a plan view of an adjustable wrist rest.

FIG. 11 illustrates a plan view of an adjustable inflatable or fluid fillable wrist rest 34. Widespread problems in the word processing and keyboard data entry industry are operator wrist fatigue, tendinitis, or "carpal tunnel syndrome" caused by the word processor or keyboard entry person having to use their hands and fingers in unusual or unnatural positions for extended periods of time. The adjustable wrist rest 34 is intended to provide support for the wrist and forearms of a word processor or keyboard entry processor. FIG. 11 illustrates in plan view the adjustable wrist rest 34, which is constructed of a trio of parallel inflatable or fillable small chambers 36, each equipped with individual valves 12, connected to a keyboard pad 38, which is designed to be positioned under the keyboard of a word processing machine. The pad 38 holds the chambers 36 in position.

Figure 12:
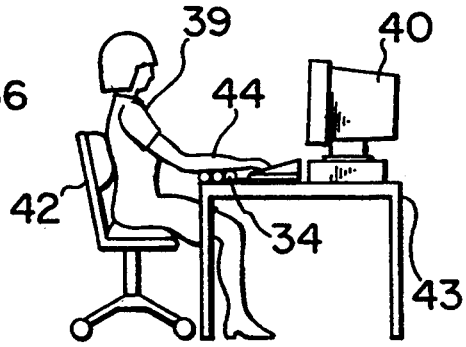
FIG. 12 illustrates a side view of an adjustable wrist rest installed in association with a keyboard of a computer and monitor.

FIG. 12 shows in a side view a word processor operator 39 sitting on a chair 42 in front of a TV monitor 40, of a typical word processing computer system. The adjustable wrist rest 34 is positioned on the desk or the table 43 so that the pad 38 fits under and is held in place by the keyboard, while the trio of small chambers 36 support the wrists and forearms 44 of the keyboard operator. The adjustable wrist rest supports the wrists and forearms of the operator and should relieve many of the problems prevalent today in the word processing and data entry industry.

Figure 13:
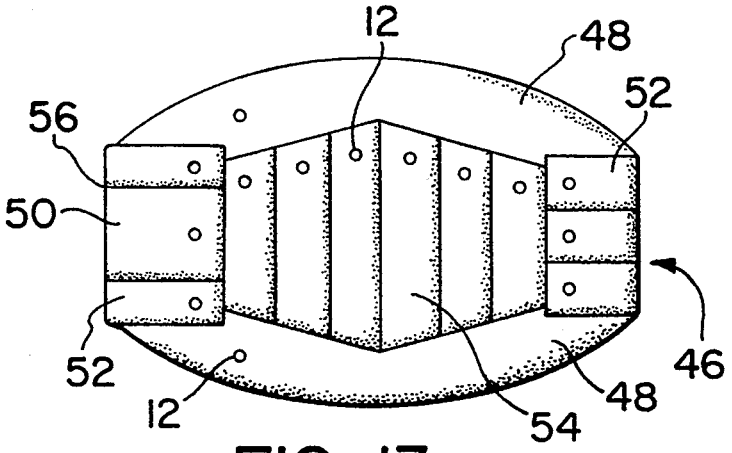
FIG. 13 illustrates a plan view of an adjustable cushion support form.

FIG. 13 illustrates an adjustable cushion support form 46 which can be used under a seating pad, or as a seating pad itself, to support the thighs and buttocks of a person wishing to sit down. The adjustable cushion support form 46 is constructed so that it has around the circumference a pair of curved laterally extending large inflatable or fluid fillable chambers 48, a medium inflatable or fluid fillable chamber 50 positioned at one end, designed to support the thighs of a person sitting on the form, and a plurality of parallel inflatable or fluid fillable small first chambers 52 positioned at each end. Each set of chambers 52 is designed to support the thighs and tail bone of a person sitting on the form. The central area of the form has a plurality of laterally extending parallel small second chambers 54. As with the other designs described previously, each chamber is equipped with its own individual valve 12 thereby enabling each chamber to be individually inflated or fluid filled to a custom pressure. This form 46 is ideal for supporting the weight of a person in a chair or wheel chair.

In many hospital or homecare situations, a person who is semi-invalid, or has sore areas of the body, or is convalescing, or is unconscious, such as in an operating room environment, must be propped up, or shifted in order to relieve discomfort, or serve other needs. In an operating room, for instance, it is sometimes necessary to move the patient being operated on. The person, while under anesthetic, provides a dead weight that is difficult to move. Moreover, certain limbs or other body regions of the patient must be propped up or supported in a specific configuration to provide access to the surgeon. At present, foam is used for this purpose, which presents a disposal problem. There is no device available on the marketplace which can provide individual specific support for individual areas of the person reclining on the form.

Figure 14:
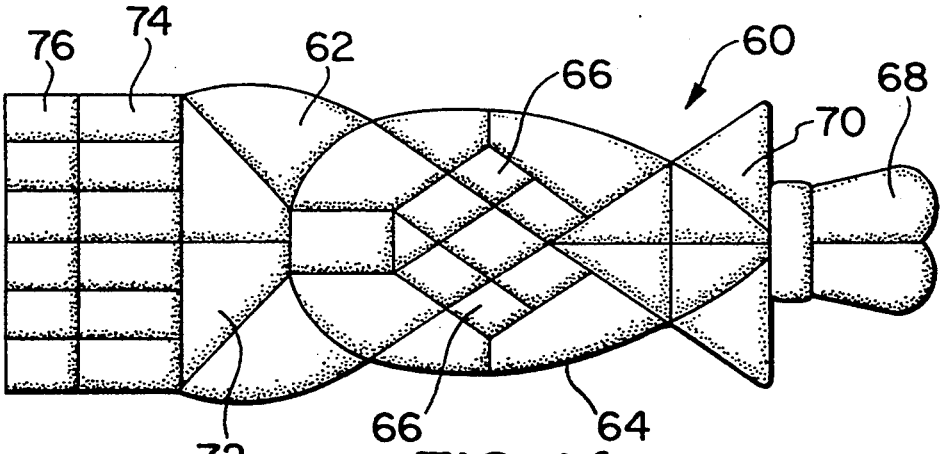
FIG. 14 illustrates a plan view of an adjustable bed or operating table pad.

FIG. 14 illustrates a plan view of an adjustable bed or operating table pad 60, which can serve the foregoing needs. The table pad 60 is constructed so that it has a plurality of independently inflatable or fluid fillable large, medium and small size chambers which are interconnected in a specific manner to provide a pattern which supports different portions of the patient's or recliner's body. As illustrated in FIG. 14, the table pad 60 has a pair of opposed large chambers 62 which are designed to support the hip and thigh area of a person or patient. Medium size chambers 64 are designed to support the torso area of the patient. A plurality of small chambers 66 are intended to support the hips and waist area of the patient. A pair of opposed matching head chambers 68 support the head of the patient. Four interconnecting shoulder chambers 70 are designed to support the shoulders of the patient. Likewise, a pair of opposed matching chambers 72 support the inner thigh area of the patient. A parallel series of chambers 74 support the leg area of the patient. A similar series of parallel chambers support the feet and calf areas of the patient. Each of these chambers can be inflated to specific pressures to meet specific needs. The chambers can be inflated with air or filled with a suitable fluid such as water. The water can be heated if desired to provide comfort to the user.

Figure 15:
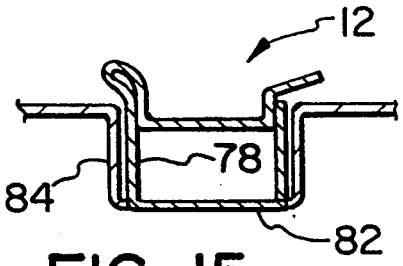
FIG. 15 illustrates a side section view of a valve.

FIG. 15 illustrates a side section view of a valve 12. The valve 12 is constructed of a barrel 78, which has a riseable cap 80 on the top and a flap 82 which opens when a positive pressure is applied on its top side, or when the barrel 78 is squeezed. The flap 82 acts as a one-way valve. The valve 12 can be pulled to an erect position by extending skirt 84 or pressed to a flush position by tucking skirt 84 into the body of the chamber. Valves of this type are used on water beds or inflatable boats.

FIGS. 16*a*, 16*b* and 16*c* illustrates in cross-section three alternative embodiments of inflated or hydraulically filled multi-compartment supports. In FIG. 16*a*, seven chambers 90, 92, 94, 96, 98, 100 and 102, are bonded to a base 104 or each other. Chamber 98 is bonded to chamber 96 and 102. Chamber 100 is bonded to chambers 98 and 102. In FIG. 16*b*, chambers 106 and 108 are bonded to a base 100 while chamber 112 is bonded to chambers 106 and 108. In FIG. 16*c*, four chambers 114, 116, 118 and 120 are bonded in sequence to each other and to base 122. In addition, chambers 116, 118 and 120 have internal chambers 124, 126 and 128 respectively. These internal chambers 124, 126 and 128 add customizing characteristics to the form, and are inflatable or fillable by connections with the other chambers. More precise shaping and a smoother transition between support chambers is possible by layering one chamber on the next. The conventional process fuses, or bonds, two surfaces, a top to the bottom (or one side to another). Bonding two, three or more surfaces can include joining chambers independent of the base or surface material. The invention involves bonding surfaces in series, not necessarily to the top, bottom or a side, but to adjacent chambers that may or may not be attached to the top, bottom or side of the device. This permits refinement of the shape and support characteristics of the support device.

FIG. 17 illustrates a top view of a support which has chambers 130, 132, 134, 136, 138, 140 and 142 inflated or filled to different pressures. FIG. 18 illustrates a section view along section line A—A of the support of FIG. 17 with progressive intersecting chambers 138 and 136.

FIG. 19 illustrates a top view of an alternative embodiment of progressive intersecting chambers support. In FIG. 19, the joints of intersection between chambers 150, 152, 154, 156, 158, 160 and 162 are staggered. Other configurations are possible. One objective is to avoid lines of weakness laterally, which would occur with linear or connecting joints. FIG. 20 illustrates a side section view along section line B—B of the support of FIG. 19. In support devices that use differing amounts of support in adjacent chambers, the transition between levels of support is made progressive and comfortable by use of a zig-zag or a modified zig-zag pattern at the chamber boundaries. This has the effect of interweaving adjacent chamber(s) boundaries as indicated in FIGS. 17 to 20.

FIG. 21 illustrates a side section view of a chamber 170 with internal baffle 172. FIG. 22 illustrates a side section view of three chambers 174, 176 and 178 of a support on a base 180 with a vertical internal central baffle 182 which shapes the top of the support. FIG. 23 illustrates an isometric view of a support 184 whose edge shape 186 is governed by an internal baffle 188 (shown in dotted lines). As seen in FIG. 23, the internal baffle 188 indents the edge 186 to provide a curved indented shape. A full or partial internal baffle, or a plurality of them, can shape a chamber to produce specific shapes to provide comfort/support as required. This concept, combined with the tapered chamber concept (see FIGS. 17 to 20) discussed above, and .the progressive support refinement concept discussed above (see FIGS. 16*a*, 16*b* and 16*c*), permit support designs which possess very precise shapes and amounts of support.

FIG. 24 illustrates a plan view of a multiple compartment loop cushion 190. The cushion is formed of five sections, 192, 194, 196, 198 and 200. FIG. 25 illustrates a cross-section view along section line C—C of the cushion 190 of FIG. 24. The interior of the cushion is a combination of chambers 202, 204, 206, 208 and 210, all designed by size and pattern to provide desired properties and qualities. A foam (or other material) centered pillow device of multiple compartments and/or shapes offers users multiple adjustable surfaces for support-/comfort. As seen in FIG. 25, as indicated with dots, the layer 194, 198, 200, is constructed of foam.

FIG. 26 illustrates an isometric view of an inflated or hydraulically filled multi-compartment support 212 with external bridge 214 over adjourning chambers 216 and 218, secured to a base 220. FIG. 27 illustrates a section view of the support 212 and bridge 214 of FIG. 26.

All of the embodiments disclosed and illustrated can be pneumatically inflated or fluid filled with a suitable fluid such as water to desired inflation or fill pressures. The various forms are typically constructed of fabric-rubber or flexible plastic-fabric components. For instance, polyethylene, by itself, or reinforced with internal fabric or textile fibres, or external fabric, is suitable. The components can be cut and glued together or heat welded together. Typically, a base is formed, and the upper parts of each chamber are secured to the base, or each other. Baffles and bridges are also included and secured.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An adjustable multi-compartment inflatable or hydraulically fillable support form comprising:

(a) at least one first hollow chamber which can be individually inflated or fluid filled through a specific resealable valve;

(b) at least one second hollow chamber which can be individually inflated or fluid filled through a specific resealable valve; and (c) at least one third hollow chamber which can be individually inflated or fluid filled through a specific resealable valve; wherein the first chamber and the second chamber are spaced from one another in parallel configuration, and there is a plurality of parallel third chambers which are positioned between the first chamber and the second chamber, and including a pair of fourth chambers which are positioned on either end of the parallel third chambers, extending laterally between the first chamber and the second chamber.

2. A form as claimed in claim 1 wherein the first chamber, the second chamber and the third chamber are joined together in parallel configuration, and each chamber is of the same overall length.

3. A form as claimed in claim 1 wherein the form has a base and the chambers are secured to the base.

4. A form as claimed in claim 3 wherein at least one of the chambers is secured to another chamber instead of the base.

5. A form as claimed in claim 3 wherein at least one of the chambers has a smaller chamber within the chamber.

6. A form as claimed in claim 3 wherein at least one of the chambers is at least partially filled with foam.

7. A form as claimed in claim 1 wherein at least one of the chambers has therein a partial baffle which is secured to an exterior wall of the chamber.

8. A form as claimed in claim 7 wherein the baffle is configured to provide a desired contour to the exterior wall of the chamber.

9. A form as claimed in claim 1 wherein the form is enclosed in polymer foam.

10. A form as claimed in claim 9 wherein the form is wrapped in an exterior fabric.

11. A form as claimed in claim 1 wherein an external bridge extends between at least two chambers which adjoin one another.

12. An adjustable multi-compartment inflatable or hydraulically fillable support form comprising:

(a) at least one first hollow chamber which can be individually inflated or fluid filled through a specific resealable valve;

(b) at least one second hollow chamber which can be individually inflated or fluid filled through a specific resealable valve; and (c) at least one third hollow chamber which can be individually inflated or fluid filled through a specific resealable valve including a pair of first chambers, each arranged parallel to and spaced from one another, with a plurality of second chambers arranged in parallel between a pair of first chambers, and a plurality of fourth chambers are arranged on either side of the parallel series of first and second chambers.

13. An adjustable multi-compartment inflatable or hydraulically fillable support form comprising:

(a) at least one first hollow chamber which can be individually inflated or fluid filled through a specific resealable valve;

(b) at least one second hollow chamber which can be individually inflated or fluid filled through a specific resealable valve; and (c) at least one third hollow chamber which can be individually inflated or fluid filled through a specific resealable valve wherein the first, second and third chambers are of the same size, and are arranged parallel to one another, the chambers being connected to a flat pad.

14. An adjustable multi-compartment inflatable or hydraulically fillable support form comprising:

(a) at least one first hollow chamber which can be individually inflated or fluid filled through a specific resealable valve;

(b) at least one second hollow chamber which can be individually inflated or fluid filled through a specific resealable valve; and (c) at least one third hollow chamber which can be individually inflated or fluid filled through a specific resealable valve including two first chambers which are curved to define an enclosed area, a second chamber positioned between meeting ends of the two curved first chambers, a plurality of parallel third chambers positioned between facing ends of the two curved first chambers, and a second plurality of fourth chambers arranged in parallel, extending laterally between the interior portions of the two curved first inflatable chambers.

15. An adjustable multi-compartment inflatable or hydraulically fillable support form comprising:

(a) at least one first hollow chamber which can be individually inflated or fluid filled through a specific resealable valve;

(b) at least one second hollow chamber which can be individually inflated or fluid filled through a specific resealable valve; and (c) at least one third hollow chamber which can be individually inflated or fluid filled through a specific resealable valve including a pair of second head supporting chambers, a plurality of third shoulder supporting chambers, a plurality of first torso supporting chambers, an interconnecting series of fourth buttocks supporting chambers, a plurality of fifth thigh supporting chambers, a pair of sixth knee supporting chambers, a plurality of parallel seventh leg supporting chambers, and a plurality of eighth feet supporting chambers.

16. An adjustable multi-compartment inflated or hydraulically fillable support form comprising:

(a) at least one first hollow chamber which can be individually inflated or fluid filled through a specific resealable valve;

(b) at least one second hollow chamber which can be individually inflated or fluid filled through a specific resealable valve; and (c) at least one third hollow chamber which can be individually inflated or fluid filled through a specific resealable valve wherein the chambers are inflated or filled to at least two pressures and the chambers are arranged so that chambers with lower pressure adjoin chambers of higher pressure, and the configuration of individual chambers and lines of intersection between the chambers are staggered.

17. An adjustable multi-compartment inflatable or hydraulically fillable support form comprising:

(a) at least one first hollow chamber which can be individually inflated or fluid filled through a specific resealable valve;

(b) at least one second hollow chamber which can be individually inflated or fluid filled through a specific resealable valve; and (c) at least one third hollow chamber which can be individually inflated or fluid filled through a specific resealable valve;

wherein the form has a base and the chambers are secured to the base, at least one of the chambers is secured to another chamber instead of the base, and the chambers are inflated or filled to at least two pressures and the chambers are arranged so that chambers with lower pressure adjoin chambers of higher pressure, and the configuration of individual chambers and lines of intersection between the chambers are staggered.

* * * * *